US005388387A

United States Patent [19]

McElvy

[11] Patent Number: 5,388,387

[45] Date of Patent: Feb. 14, 1995

[54] PACKAGING FILM FEEDING AND SPLICING APPARATUS AND METHOD

[75] Inventor: Howell T. McElvy, Decatur, Ga.

[73] Assignee: Kliklok Corporation, Decatur, Ga.

[21] Appl. No.: 30,985

[22] Filed: Mar. 12, 1993

[51] Int. Cl.[6] ..... B65B 41/14; B65B 41/18; B65B 9/20

[52] U.S. Cl. ..... 53/451; 53/51; 53/551; 53/389.2; 242/554.4; 242/556; 242/420.1; 242/421; 156/502;

[58] Field of Search ..... 53/451, 551, 51, 389.2, 53/389.4; 242/58.1, 58.5, 75.2, 180, 201, 184; 156/502, 504, 505

[56] References Cited

U.S. PATENT DOCUMENTS

| | | | |
|---|---|---|---|
| 3,983,774 | 10/1976 | Seragnoli | 53/389.4 X |
| 4,190,483 | 2/1980 | Ryan et al. | 156/505 X |
| 4,450,039 | 5/1984 | Salvucci et al. . | |
| 4,455,190 | 6/1984 | Bianchetto et al. . | |
| 4,467,589 | 8/1984 | van Maanen | 53/389.4 X |
| 4,541,221 | 9/1985 | Seragnoli | 53/389.4 X |
| 4,543,152 | 9/1985 | Nozaka | 156/502 |
| 4,578,931 | 4/1986 | Roovers | 53/551 |
| 4,645,558 | 2/1987 | Sato | 156/504 X |
| 4,668,328 | 5/1987 | Kyytsonen . | |
| 4,683,022 | 7/1987 | Watanabe et al. . | |
| 4,691,499 | 9/1987 | Umeda et al. | 53/389.4 X |
| 4,695,007 | 9/1987 | Muto et al. | 53/389.4 X |
| 4,720,320 | 1/1988 | Niemi | 156/505 X |
| 4,722,489 | 2/1988 | Wommer . | |
| 4,880,178 | 11/1989 | Goulette . | |
| 4,995,936 | 2/1991 | Cohn . | |
| 5,045,134 | 9/1991 | Schenker et al. | 156/504 X |
| 5,064,488 | 11/1991 | Dickey | 156/504 X |

*Primary Examiner*—Horace M. Culver
*Attorney, Agent, or Firm*—King & Schickli

[57] ABSTRACT

An assembly and method provide a continuous supply of packaging film to a form, fill and seal packaging machine with two spindles alternately operating as the active spindle to feed the film from one roll at a time. Opposed pneumatic manifolds are operative to splice the tail-end of the film from the active roll to the head-end of the film from the standby roll. The opposed manifolds pivot in opposite directions away from the machine to provide easy access for loading. A programmable controller controls the splicing operation. Valves operated by the controller connect a vacuum source to one of the manifolds to hold the head-end at a splicing station and to the other to maintain tension on the active film after the tail-end leaves the spindle. An end-of-roll detector near the spindle triggers the tensioning function. The width of the manifold is adjustable to accommodate different width film. A photocell detector and encoder in the circuit allow tracking of the tail-end. When it arrives at the splicing station, the appropriate control valve rapidly switches to apply an air blast generated by positive pneumatic pressure to blow the tail-end/head-end together so that adhesive tape pre-applied to the head-end is securely attached to the tail-end to complete the splicing operation. The programmable controller continues to track the splice through the packaging machine to initiate a dry cycle and removal of the splice section.

18 Claims, 6 Drawing Sheets

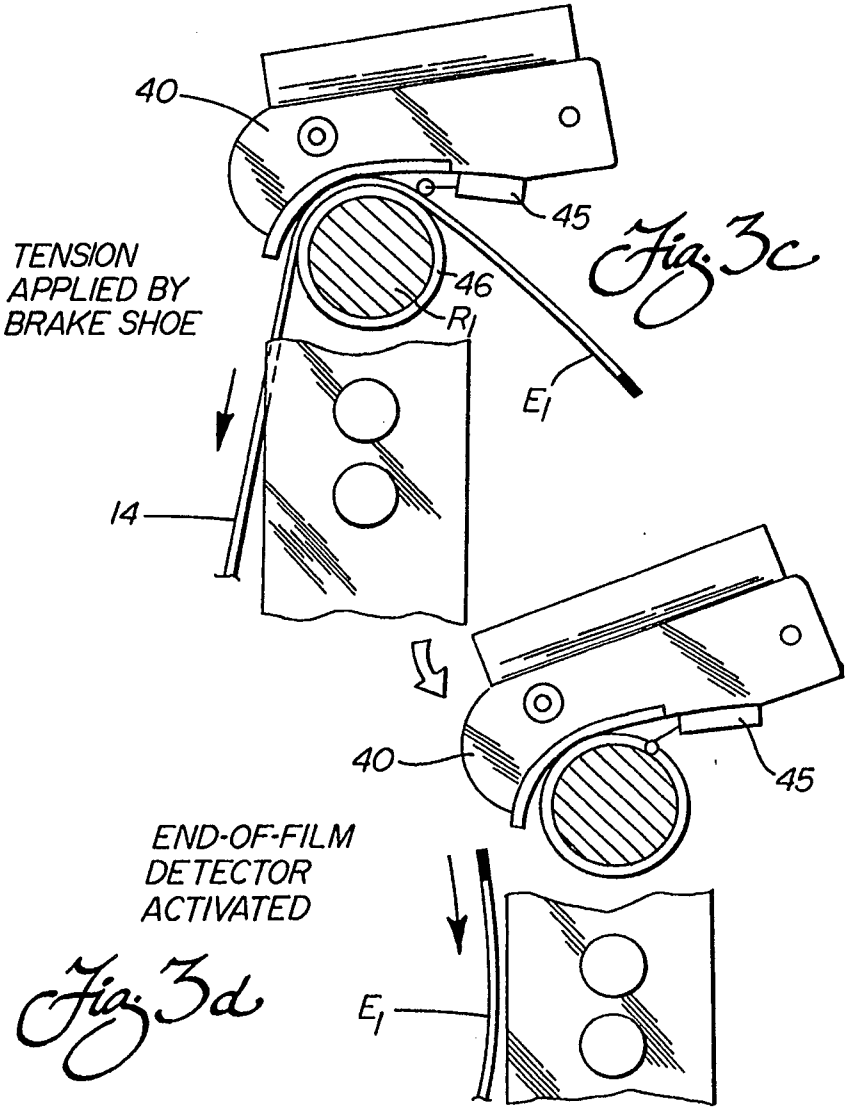
Fig. 3c
Fig. 3d
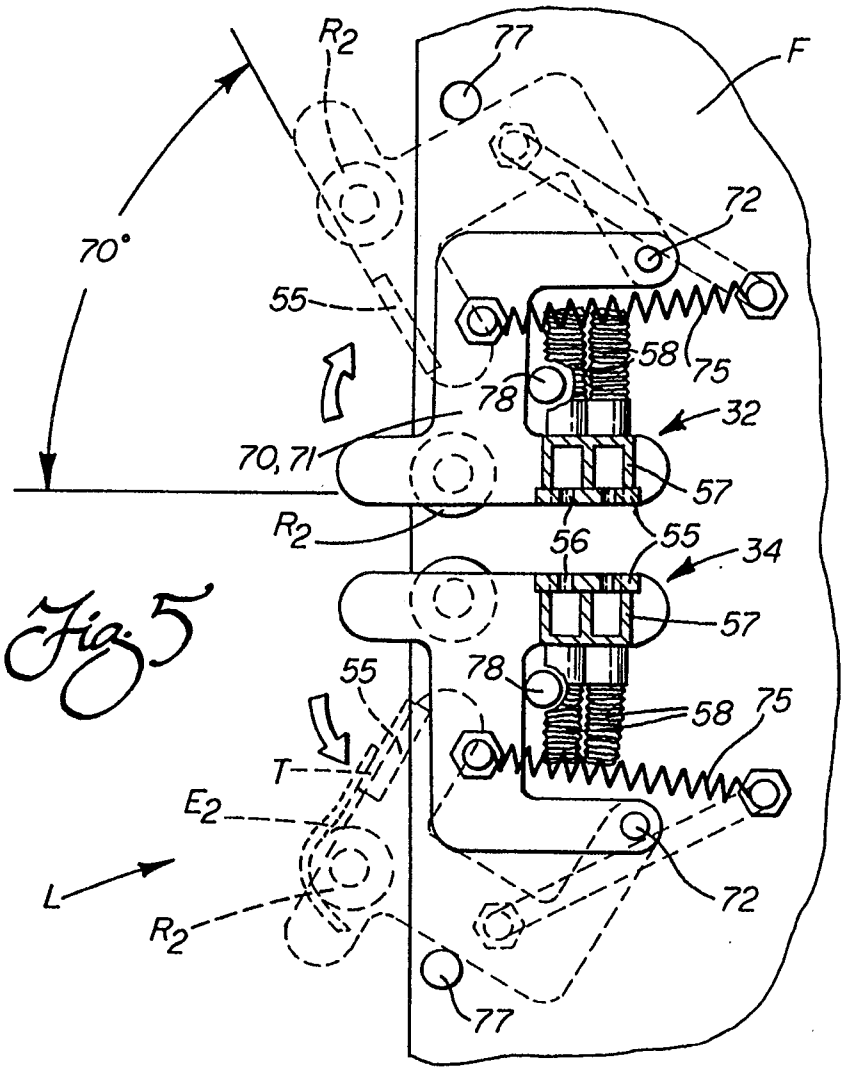
Fig. 5

PACKAGING FILM FEEDING AND SPLICING APPARATUS AND METHOD

TECHNICAL FIELD

The present invention relates to feeding film into a form, fill and seal packaging machine and, more particularly, to continuous film feeding that eliminates interruptions associated with loading a new supply roll of film.

BACKGROUND OF THE INVENTION

Assemblies and methods for unwinding and feeding of packaging film into a form, fill and seal packaging machine are known in the art. A number of other machines that process web material similar to film, such as printing presses, employ similar feeding assemblies and methods. These feeding assemblies typically include means for supporting and unwinding a supply web roll and means for feeding the web into the processing machine.

In the case of a form, fill and seal packaging machine, the film is ultimately formed into an open package, filled with a product, and sealed to retain the product until opened for use. A wide variety of products, most notably food items, are packaged in this manner. To further explain, the basic combination of a form, fill and seal packaging machine is disclosed in U.S. Pat. No. 4,727,707, assigned to the assignee of the present invention. It discloses a method and assembly for controlling the feed of packaging film from a supply roll over a former, where the film is formed into an open tube. A filling means provides a measured amount of product into the bottom of the tube where a package or bag is being formed. The package is then sealed across the top to yield a filled, hermetically sealed package with the product on the inside (see FIGS. 2–4). The '707 patent actually covers a particular improved control routine for film registration utilizing registration marks detected by a photoelectric cell and triggering the various form, fill and seal operations.

It is desirable to minimize the down-time of the packaging machine so that a maximum number of packages or bags can be produced during each unit time. This necessarily means that not only is a reliable high speed package forming, filling and sealing operation required, but also a reliable high speed film feeding/registration arrangement is a necessity, as illustrated in the '707 patent.

In prior art assemblies, film is typically supplied for feeding along the feed path into a form, fill and seal portion of the machine by loading or installing a roll of the film on a spindle or web roll cradle, and controllably rotating the roll to unwind the film. A significant disadvantage of these prior art packaging film unwinding arrangements is the lost operating time caused during change-over when a roll of film is exhausted and a new roll must be loaded and brought on stream. This change-over typically requires an operator to stop the packaging machine to load a new roll of film on the spindle or cradle, thread the film along the feed path and then restart and regulate the machine operation. Typically, lost machine production time is between 10–30 minutes.

The potential lost operation time can be further magnified because a single operator is, in many instances, required to keep several machines operating simultaneously. Thus, if two or more machines require a new roll to be loaded at about the same time, or an emergency occupies the operator's attention at a time when a new roll of film is required, the interruption and lost operating time are detrimentally increased.

Some prior art feeding assemblies and methods have sought to correct or alleviate this problem by incorporating dual roll supporting and unwinding equipment so that upon exhaustion or expiration of an active roll, the threading of the film from a standby roll can begin immediately. This reduces the roll change-over interruptions because the operator can have the standby roll pre-loaded in the machine. Thus, the overall down-time of the packaging machine is reduced.

Some web feeding approaches for other types of machines have suggested going a step farther to include a provision for automatically splicing the tail-end of the web of the active roll to the head-end of the web of the standby roll so that the web is truly continuously fed without any roll change-over interruption.

In these web feeding assemblies and methods, it is highly desirable to include provision for implementing the splicing by a control means upon detection of the tail-end of the web of the active roll being at a splice position along the feed path. In addition, upon expiration of the active roll of the web and its release from the spindle, there must be provisions for maintaining tension on the web. This is necessary to maintain tracking of the web through the machine and to ensure that the tail-end is properly oriented to be spliced upon reaching the splice position.

When successful, this splicing operation alleviates much of the problem of a single operator trying to keep several machines operating simultaneously. It can result in minimizing, and indeed, eliminating roll loading and change over interruptions. The operator has a much wider window of time within which to load new rolls on the machines without risking interruption and lost operating time. In theory, an operator merely installs a new roll onto the standby spindle at any time during unwinding of the active roll prior to its expiration, and the machine can continue operating indefinitely without interruption.

However, prior art methods and assemblies for feeding webs supplied on rolls into processing machines including such splicing provisions possess significant drawbacks and disadvantages. For instance, the arrangements that I am aware of employ moving mechanical parts to mechanically move the head-end and tail-end of the webs into splicing engagement. Adhesive means typically located between the head-end and tail-end are designed to hold them together once the webs are forced together. These moving mechanical parts typically are opposing plungers or plates that forcefully slap the head-end/tail-end together upon detection in real time of the head-end and tail-end being present between them.

Moving mechanical parts utilized to mechanically slap the head-end/tail-end of webs together in this manner are subject to inordinate wear and tear. Heavy maintenance and continuous adjustment to account for the wear that occurs are commonplace complaints of the operators. Furthermore, this brute force approach tends to cause the web to burst if a slight error in synchronization of the operation is experienced.

It is also known that slapping the head-end/tail-end of the webs together with adhesive located between them is particularly problematic when the adhesive is applied in liquid or paste form. Particularly when applied in excessive amounts, the adhesive can squeeze out due to the excessive force of the slap action, resulting in it tending to clog around the moving mechanical parts, and eventually impede or jam their operation.

Another drawback of prior art web feeding assemblies and methods is the lack of convenient operator accessibility to load the head-end of the web of the standby roll into the splice ready position. Specifically, prior to expiration of the active roll, the operator loads the head-end into a holding means in the splice ready position where it is maintained awaiting the tail-end of the web of the active roll. Typically the web of the active roll is in close proximity to the holding means, and manual intervention can cause inadvertent interference and damage to the feeding of the web of the active roll. Shut-down of the processing machine results.

Another problem associated with prior art feeding assemblies and methods that include splicing provisions is the subsequent processing and handling of the head-end/tail-end splice section. That is, the splice section must be retained along the feed path throughout the entire processing machine to maintain the continuous web until the final cut-off point in the process. It is desirable to track the splice section through the entire machine, to inhibit further processing of it, and to recognize it at the cut-off point and dispose of it. Prior assemblies and methods have not addressed the problems of tracking the splice section through the machine to inhibit its processing, and/or to remove it after cut-off.

U.S. Pat. No. 4,455,190 to Bianchetto et al. discloses an apparatus and method for splicing two webs together so that the web is substantially continuously fed into a processing machine. In this case the processing machine is a printing press (see column 1, lines 14–15). The webs are fed from two rolls and spliced together at a splicing station (see FIG. 1). This prior art apparatus utilizes vacuum means for holding the head-end of the web of the standby roll at the splicing station. The web of the active roll as it is expiring causes actuation of a pneumatic cylinder and, correspondingly, downward movement by the plate thereby slapping the two films together. The objective is for both webs to adhere to the adhesive strip between them, effecting a splice (see FIGS. 4D–4G).

This '190 patent also includes a suggestion for retracting the holding means to facilitate loading of the head-end of the web of the new roll so as to be positioned spaced from the splicing station (see FIGS. 4A–4C). However, no mounting details are provided and an operator must move several other components out of the way to permit the movement.

U.S. Pat. No. 4,880,178 to Goulette also discloses an arrangement for splicing the head-end of web of a standby roll to the tail-end of the web of an active roll so that continuous or semi-continuous feeding is effected. The control bar moves downwardly (FIGS. 10 and 11), causing the webs to be slapped together with a tape in between to thereby implement a splice.

Similarly, U.S. Pat. No. 4,722,489 to Wommer discloses a device for splicing the web head-end of a standby roll to the web tail-end of an active roll (see FIG. 1). Again, moving plates 3 must slap the head-end/tail-end together (see FIG. 4) to effect a splice.

Thus, all of these prior art assemblies and methods for splicing two webs together include mechanical moving parts subject to great wear and tear and a tendency to stress, and possibly burst the web just from normal operation. As a result, the parts tend to require regular maintenance at short intervals and continuous adjustment, and occasional shut-down of the machine is required to manually splice a broken web, and rethread the web. In addition, none of the references teach a device or method for tracking the splice section through the machine so that further processing of the splice section can be inhibited, and thus efficiently discarded. Inhibiting the processing of the splice section is referred to as operating the machine in a "dry cycle mode."

Thus, despite these prior art attempts, the continuous feeding of a web, and particularly relatively thin flexible packaging film for use in a form, fill and seal packaging operation, by splicing the film of the rolls together, remains a difficult, and generally problematic procedure. Specifically, (1) the presence of moving mechanical parts to slap the webs together; (2) the lack of a simple means for retracting the head-end holding means to facilitate loading of the new standby roll; and (3) the lack of any provision for efficiently tracking the splice section through the machine and inhibiting its further processing, are particularly identified.

SUMMARY OF THE INVENTION

Accordingly, it is a primary object of the present invention to provide an improved apparatus and related method for substantially continuously feeding a web, and particularly packaging film into a form, fill and seal packaging machine, overcoming the above described limitations and disadvantages of the prior art.

Another object of the invention is to provide an apparatus and method for splicing a web, and particularly the moving film of two rolls of packaging film, together where mechanical parts are not utilized to slap the two films together to implement a splice between them.

It is yet another object of the present invention to provide a splicing assembly and method whereby an operator can load a standby roll of film at any time during feeding of an indeterminate length web or film from an active roll, and splicing is automatically implemented by a control circuit at the appropriate time so that substantially no interruption in web or film feeding occurs between the active roll and the standby roll.

It is another object of the present invention to provide a splicing assembly and method where it is possible to track the splice section through the machine and to inhibit its processing, particularly by a form, fill and seal packaging machine, and to ultimately dispose of it.

It is another, and related objective to provide an assembly/method for splicing two rolls of a web or film so that the splice section and any tail is as short as possible to minimize waste.

It is still another object of the present invention to provide an improved assembly and method for loading a head-end of a standby roll at the splicing station wherein the holding means for said head-end is retractable to provide easy operator accessibility spaced substantially away from the splicing station.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, an improved assembly and method of web feeding, and particularly for substantially continuously feeding packaging film into a form, fill and seal packaging machine is provided. Film is fed substantially without interruption even when changing from one supply roll of film to the next or standby roll by splicing the tail-end of the film of the active roll to the head-end of the film of the standby roll. The splicing is effected by blowing the head-end/tail-end toward each other sufficiently for both to engage adhesive tape on the head-end, thereby eliminating the need for moving mechanical parts to forcefully slap them together. Preferably, only the head-end of the film is blown from its position at the splicing station toward the tail-end of the active roll.

The assembly of the present invention specifically includes means for alternately supporting and unwinding an active roll of film and a standby roll of film and means for substantially continuously feeding and controlling the film of both rolls. Opposed pneumatic means applies first a vacuum source to hold the head-end of the film of the standby roll and attached adhesive tape at the splicing station and, further, to provide constant tension on the film of the active roll at the splicing station, at least during the travel as the tail-end approaches. At other times, an upstream mechanical drag shoe, or auxiliary roller brake, provides the required tension of the web being fed. Adjacent the drag shoe is a micro-switch that incorporates a switching function to detect the tail-end passing from the roll. Each spindle is controlled as necessary to match the tangential speed of the spindle to the linear speed of the film, such as by a separate roll brake to prevent the inertia of unwinding to spin the active roll out-of-control.

The pneumatic means rapidly switches at the proper time to preferably apply a positive pressure source producing a controlled air blast that blows the head-end of the film of the standby roll toward the tail-end of the film of the active roll so that the tail-end sticks to the adhesive on the head-end. A control circuit, including a programmable controller, performs the rapid switching of preferably one, or in some instances, both of the pneumatic means from vacuum to positive pressure.

It is also preferred that the pneumatic means includes opposed elongated, transversely mounted manifolds. The effective widths of the manifolds can be adjusted by moveable dams. This allows application of the vacuum source or pressure source across a width corresponding to the width of the film.

It is further preferred that the assembly of the present invention includes simple pivotal mounting means for the opposed pneumatic means that allows movement away from the splicing station for improved operator accessibility to load the head-end of the film of the standby roll.

The control routine of the present invention also preferably includes means for detecting eyemarks on the film, and through the programmable controller and other detectors, such as an end-of-film detector and bag length encoder in the control circuit, to preferably determine when the second to last eyemark on the film of the active roll arrives at the splicing station, and then effecting the rapid switching from the vacuum source to the pressure source for splicing. In the instance where only a partial final package or bag length is left on the active roll, the last eyemark and an unmarked tail is of course the one that is positioned at the splicing station when the splice is formed.

In a further aspect of the present invention, and in accordance with its objects and purposes, a form, fill and seal packaging machine is provided wherein the splicing assembly and method allow substantially continuous film feeding, and creates a recognizable splice section for later identification and disposal. To do this, the forming means, sealing means and filling means of the machine are all coordinated so as to provide a dry cycle operation of the machine as the splice section reaches the point where the packages are formed, so that all completed formed, filled and sealed packages are acceptable.

The method of the present invention for substantially continuously feeding packaging film into a form, fill and seal packaging machine from an active and a standby roll includes the steps of supporting and unwinding film from the active roll, applying adhesive means to the head-end of the film of the standby roll and holding the head-end at a splicing station while constantly tensioning the film of the active roll. Positive pressure is applied to generate the air blast across the splicing station to blow the head-end of the standby film toward the tail-end of the active film so that they are securely spliced to provide substantially continuous film feeding into the machine.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

FIGS. 3*c* and 3*d* compliment the showing of FIGS. 2*a* and 3*a* by illustrating in more detail the operation of the drag shoe and the end-of-film detector;

FIG. 5 is a side view enlargement of the splicing station illustrating the pivotal mounting of the opposed pneumatic manifolds for film tensioning/holding that allows easy alternate loading of the head-end of the film of the standby roll.

DETAILED DESCRIPTION OF THE INVENTION

Figure 1:
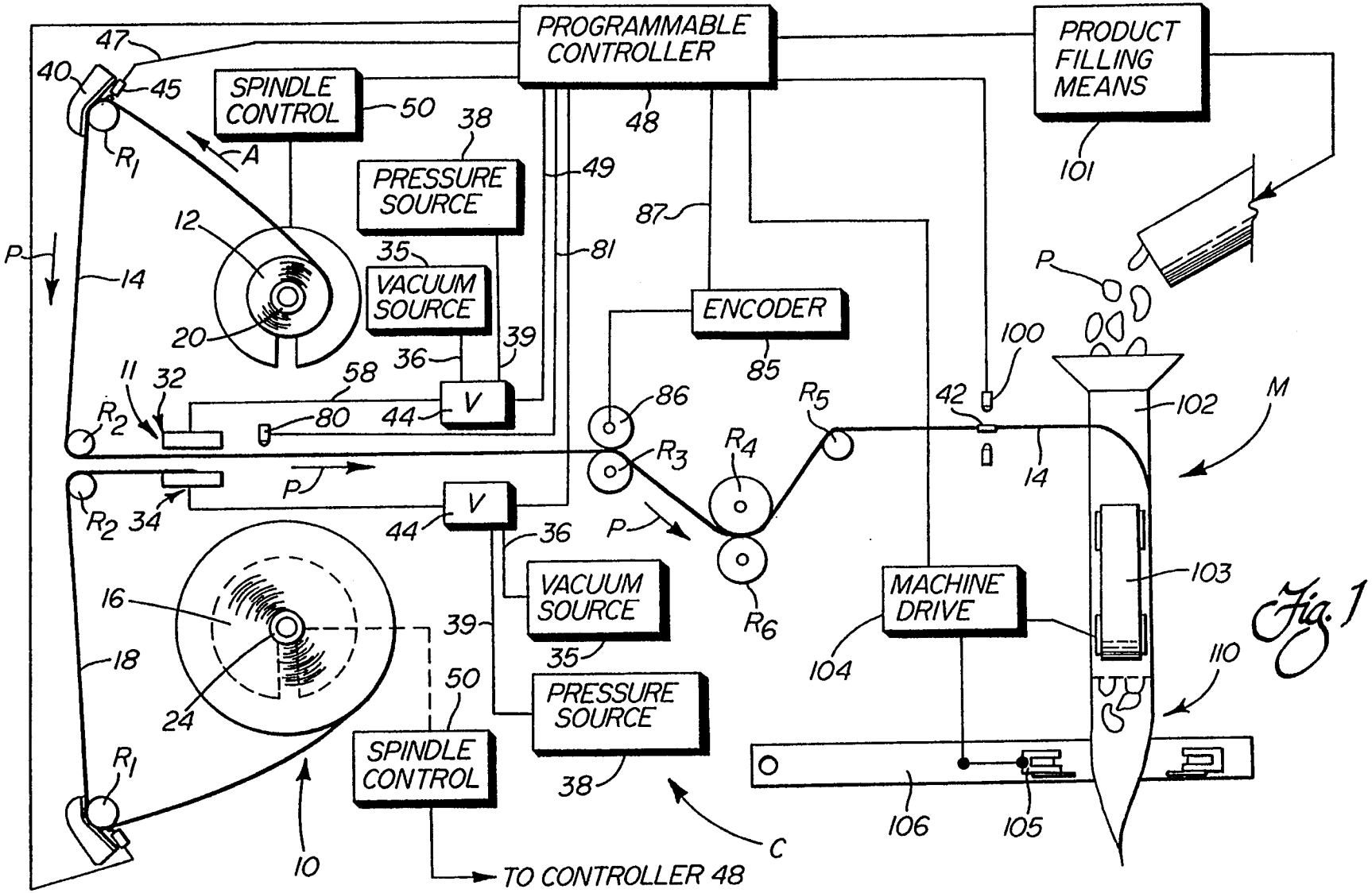
FIG. 1 is a schematic side view of an assembly for substantially continuously feeding packaging film to a form, fill and seal packaging machine embodying features of the present invention.

Reference is now made to FIG. 1 schematically illustrating an assembly 10 for substantially continuously feeding packaging film into a form, fill and seal packaging machine M. The film feeding assembly 10 includes a splicing station 11 and relevant components of a control circuit C. An active roll 12 of film 14, and a standby roll 16 of film 18 are shown as a part of the feeding assembly 10. As will be described further herein, the novel means for splicing the two films together is provided at the splicing station 11. While the preferred embodiment of the invention is described with respect to packaging film, it is understood that in accordance with its broader aspects, other types of indeterminate length webs can be spliced using the novel principles. This is particularly true with respect to relatively thin, plastic and composite webs.

Figure 2B:
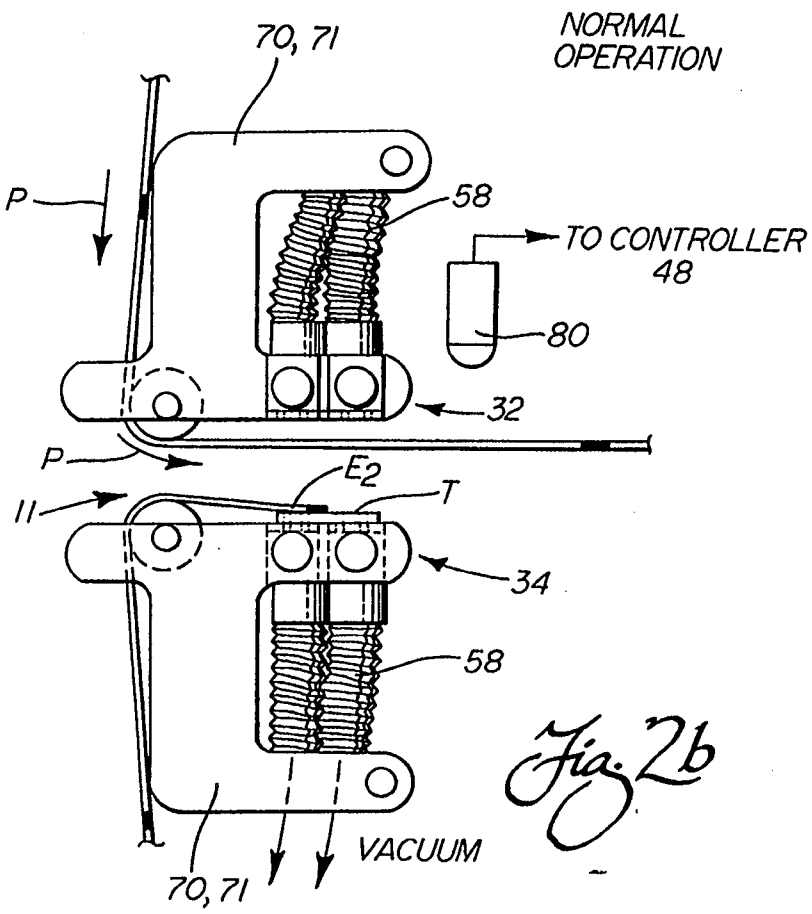
FIG. 2*b* is an enlargement of the splicing station of FIG. 2*a* and illustrating the relative position of the two films.
Figure 2A:
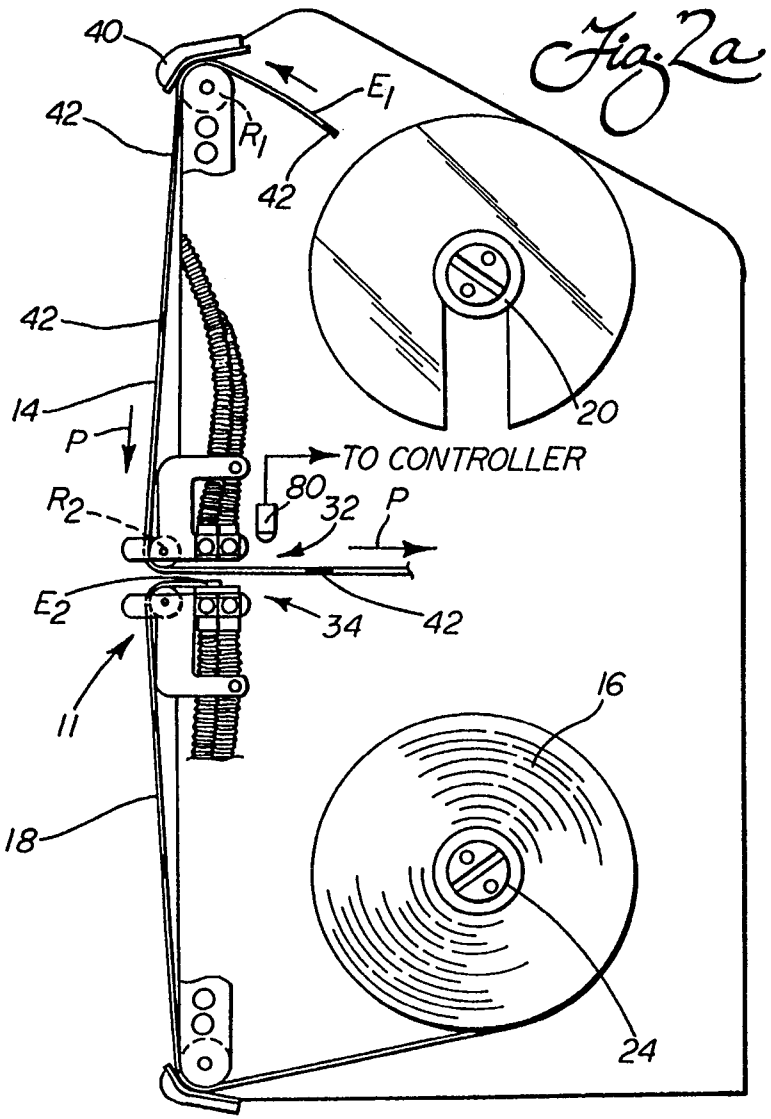
FIG. 2*a* is a partial schematic side view of the film feeding assembly including the splicing station and showing the tail-end of the active roll film after leaving the spindle and being tensioned by the drag shoe.

The active roll 12 is installed on and unwound from a spindle 20 so that the film 14 is substantially continuously fed along the feed path, indicated by the arrows P. The standby roll 16 is similarly installed on a spindle 24. As shown in FIG. 2*a*, the active roll 12 is unwound until its tail-end $E_1$ of the film 14 leaves the spindle 20. Thereafter, the tail-end $E_1$ is pulled along the feed path defined by idler guide rollers rolls $R_1$, $R_2$ until it reaches the splicing station 11. The two rolls 12, 16 are alternately the active and standby rolls; and accordingly, a description is provided for only the mode of operation where the roll 12 serves as the active roll, as shown in FIGS. 1 and 2*a*. It is to be understood that as the rolls 12, 16 alternate between the active/standby status, the operation is basically the same, so that a single detained description and corresponding reference numerals are appropriate. As described, the roll 12 is the active roll and the roll 16 is the standby roll (see FIG. 1).

Upon reaching the splicing station 11, the tail-end $E_1$ is tensioned by a first pneumatic means or manifold 32 and spliced to the head-end $E_2$ of the film 18. As a result, the film 14, 18 is substantially continuously fed without interruption into the machine M along the feed path P defined by rollers $R_1$–$R_5$ (see FIG. 1). The roller $R_4$ forms a film driving nip with opposed roller $R_6$. This roller couple, or similar couple, keeps constant tension on the film 14, 18 along the feed path P, and serves to turn the corresponding spindle 20, 24 during normal feed operation. After completing the splice, the new film 18 from the standby roll 16 continues to be fed along the path for packaging.

The film 18 of the standby roll 16 is prepared to be spliced by simply holding the head-end $E_2$ at the splicing station 11. Specifically, this is accomplished by roughly trimming the head-end $E_2$, applying single-sided adhesive tape T and placing the tape so that its non-adhesive side is held on the second pneumatic means 34. This is done by applying suction from a vacuum source 35 (see FIG. 2*b*). The tape T has its adhesive side facing upwardly toward the film 14 (see FIG. 2*b*). The head-end $E_2$ covers and adheres to approximately one-half of the exposed adhesive side of the tape T. Subsequent application of a controlled blast of air from a pressure source 38 to the second pneumatic means 32 sufficiently blows the head-end $E_2$ along with the exposed half of the adhesive side of the tape T so that it adheres to the tail-end $E_1$ to complete the splice. The positive pressure source 38 to generate the air blast is applied through line 39 and valve 44. The vacuum source 35 is applicable through the same control valve 44 in a similar manner through line 36.

As mentioned above, the driven rollers $R_4$, $R_6$ provide tension in the web 14 during normal operation, that is as long as the active roll 12 remains. As soon as the tail-end $E_1$ is released from the spindle 20 (see FIG. 2*a*) the tension is maintained by a brake shoe 40 acting against the roller $R_1$ (see FIG. 2*a*). Alternatively, the brake shoe 40 can be replaced by a brake roller as an option. As illustrated, the tail-end $E_1$ may terminate at an eyemark 42 that is printed on the film 14 itself. Note in FIG. 2*a*, as well as the other figures, the spacing of the eyemarks 42 which identify individual bags. In reality, the eyemarks 42 are located at an intermediate point along the bags for the purpose of control of the packaging machine M, and as more fully set forth in the '707 patent, as mentioned above.

To complete the tensioning function, once the tail-end $E_1$ is pulled from between the brake shoe 40 and the roller $R_1$ (see FIGS. 3*c*–3*d*), a microswitch 45 having a feeler that rides on the film 14 drops into a groove 46, which in turn activates the valve 44 to provide suction at the pneumatic means or manifold 32. This action, which will be explained more in detail below, provides for tensioning of the film 14 at least adjacent the tail-end as the splicing station 11 is approached (see FIGS. 3*a* and 3*b*).

Figure 3B:
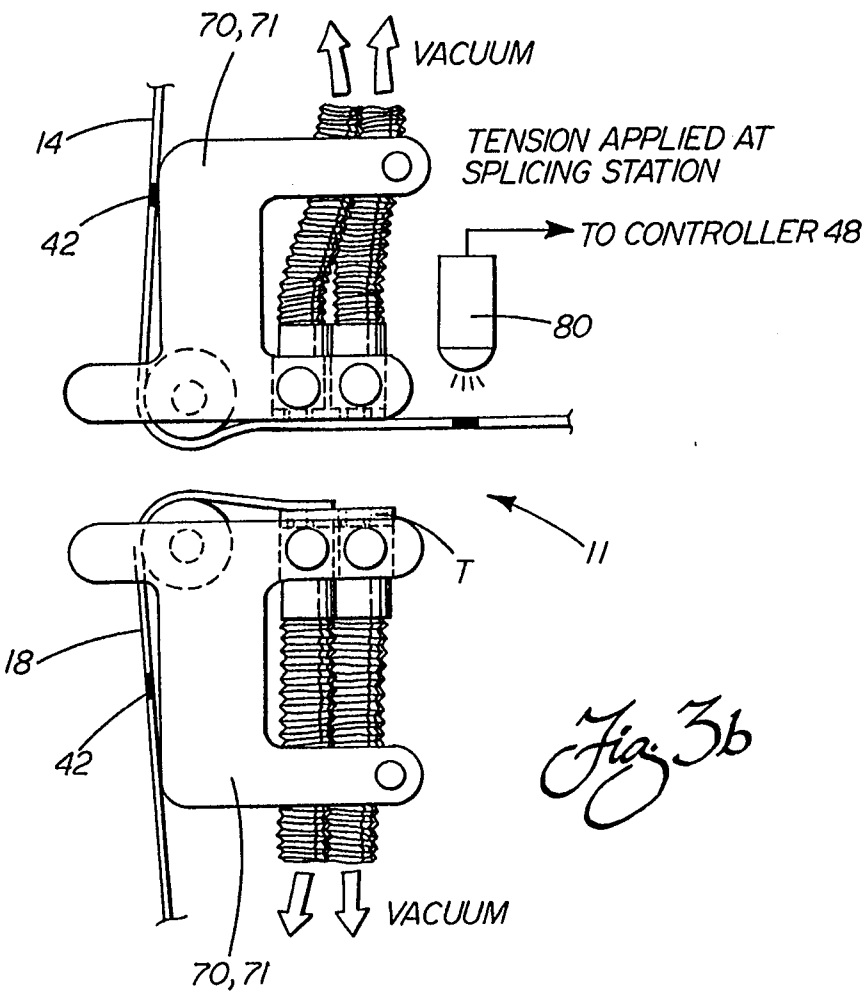
FIG. 3*b* is an enlargement of the splicing station of FIG. 3*a* and also showing the initiation of the counting of the bag lengths remaining on the active film.
Figure 3A:
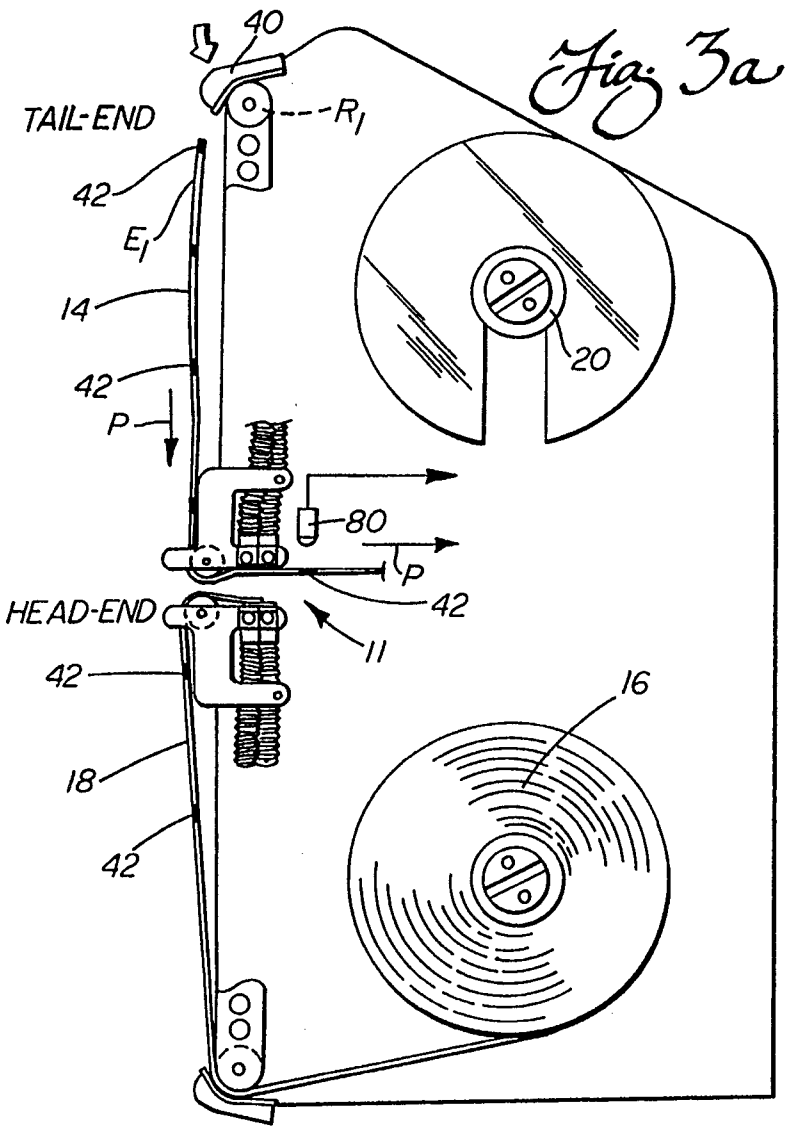
FIG. 3*a* illustrates the splicing station just after the tail-end of the active roll film activates the end of film detector initiating application of the vacuum source to the manifold to provide the tension on the active roll film.

As will be realized, the microswitch 45 is connected by an electrical line 47 to a programmable controller 48, which components are a part of the control circuit C. As illustrated, the programmable controller 48 through a line 49 is what controls the valve 44. At the moment the microswitch 45 is triggered (see FIGS. 3*c*–3*d*) the valve 44 is operative to switch to the vacuum line 36 in order to provide the suction required to attract the film 14 and apply tension at the splicing station 11, as best shown in FIGS. 3*a*, 3*b*. This action is particularly advantageous, and as will be seen in further detail below, since the tension is now directly applied where the splicing function occurs. As will be apparent to those skilled in the art, the programmable controller 48 can be selected from any one of a number of off-the-shelf controllers having sufficient capabilities of operating from a number of input signals and controlling a number of operating mechanisms.

Figure 4B:
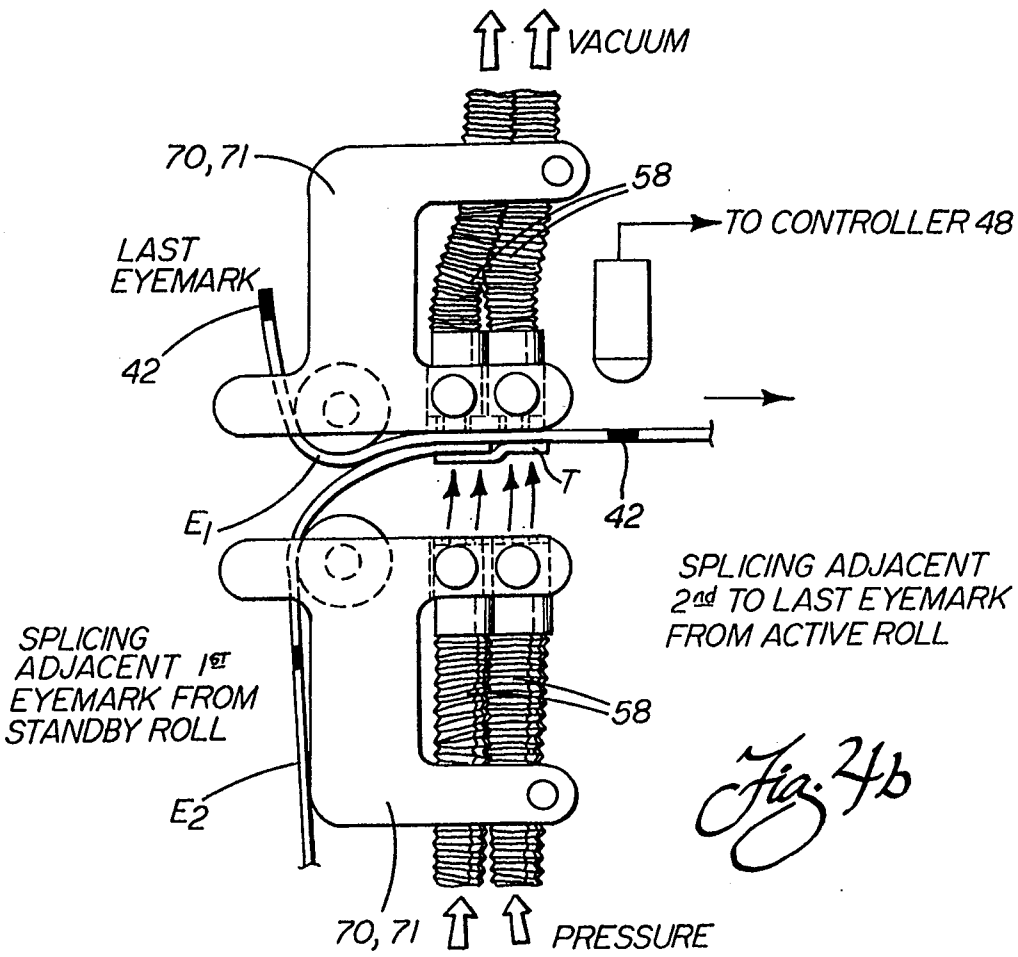
FIG. 4*a* and 4*b* are partial schematic side views of the assembly at the point in the cycle when the encoder counts up to the next to last eyemark on the film of the active roll, at which time positive pressure is applied at the manifold adjacent the head-end to generate an air blast and blow the head-end toward the tail-end to splice them together.
Figure 4A:
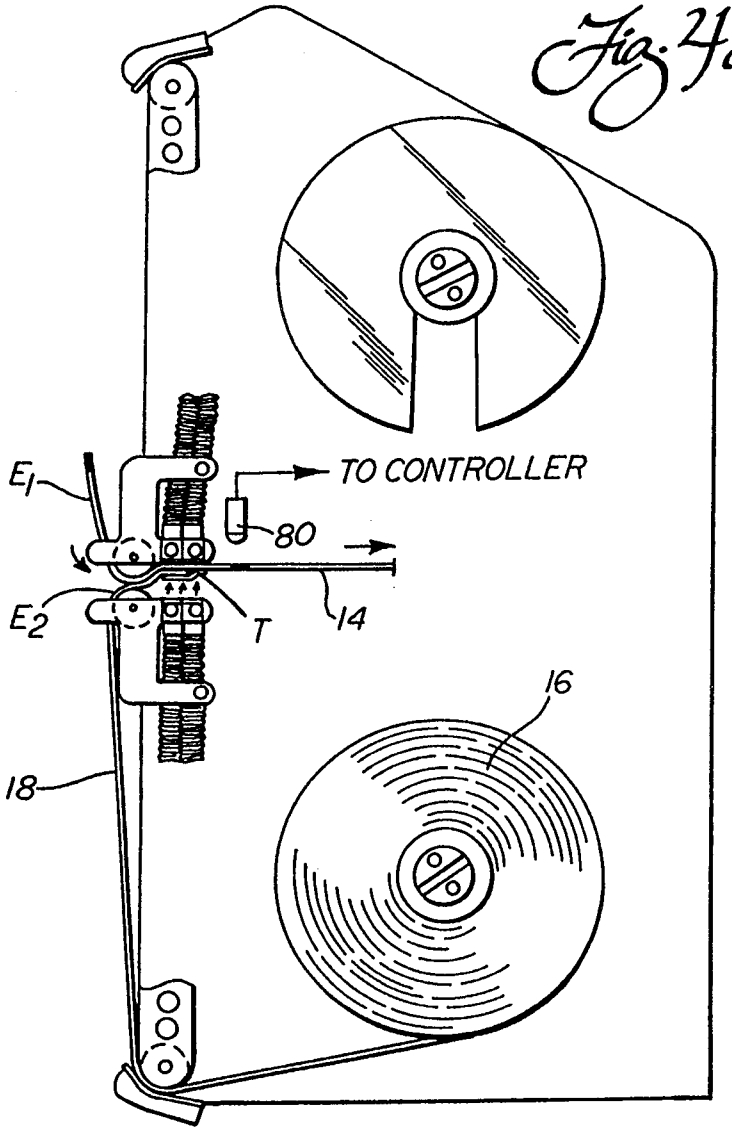

Once the tail-end $E_1$ of the film 14 reaches the splicing station 11, in a precise manner as explained below, the controller 48 is operative to switch the valve 44 from the vacuum line 36 to the positive pressure line 39. In response to this triggering action, the pressure source 38 generates a blast of air to positively, but controllably, blow the head-end $E_2$ toward the tail-end $E_1$ of the active film 14 from the roll 12 (see FIGS. 4*a*, 4*b*). In accordance with the invention, the flow of air is sufficient to force the head-end $E_2$ into firm contact with the tail-end $E_1$ so as to cause said tail-end $E_1$ to stick to the adhesive tape T. At this moment, the film 18 of the standby roll 16 is securely spliced to the film 14 of the previously active roll 12 to provide film feeding to the packaging machine M that is substantially without interruption and without slowdown. Furthermore, the splicing action is carried out without the deleterious effect of forcefully slapping the film together by mechanical elements, which in the past causes problems of machine maintenance and the tendency to burst the film.

As another part of the control circuit C, there is provided a spindle control 50 to make certain that the speed of the web 14 of the active roll 12, as well as the speed of the film from the standby roll 16 substantially matches the speed of the film 14, 18, respectively, as it progresses along the feed path P (see FIG. 1). As presently contemplated, the spindle control 50 may include positive braking/driving means to accomplish this purpose. While it is possible to momentarily interrupt the feeding of one or both of the films 14, 18, it is highly desirable to provide substantially continuous operation by incorporating the spindle control 50 with braking and/or positive drive.

Figure 6:
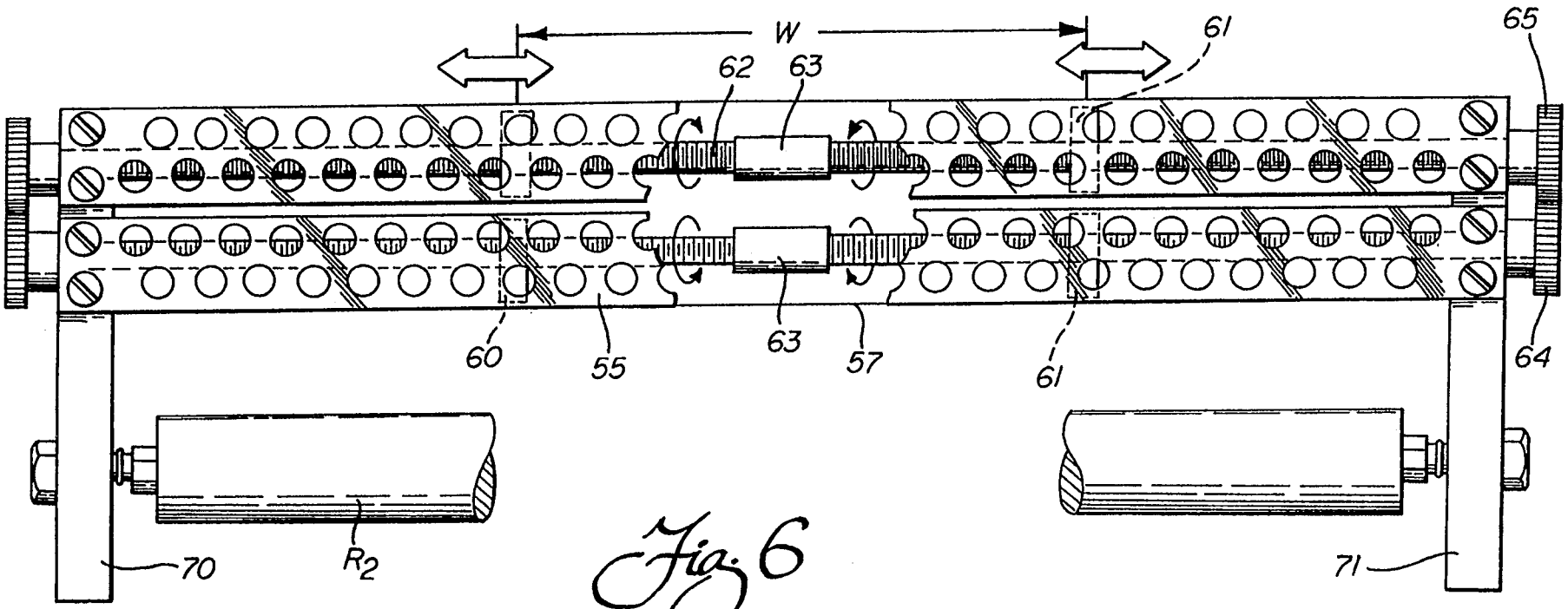
FIG. 6 is a plan view of one of the pneumatic manifolds for film tensioning/holding and illustrating the oppositely threaded rods engaging dam members that define the effective width of the manifold.

As best shown in FIGS. 5 and 6, the pneumatic means/manifolds 32, 34 preferably takes the form of a manifold plate 55 with spaced openings 56 through which the suction/blast of air is alternately applied. The manifolds include an elongated housing 57 and inlet ports/tubes 58 (see also FIGS. *2b*, *4b*). As indicated above, the inlet ports/tubes 58 are connected to the valve 44 through a suitable connection, and serve to provide the suction/blast of air as required for the film final tensioning/holding functions, and the splicing operation.

As best shown in FIG. 6, the elongated housing 57 is in two sections and each includes means for adjusting the effective width W of each manifold plate 55; the width W corresponding to the width of the film 14, 18 that is being spliced, and which is used to form the package or bag, as will be seen in more detail below.

In particular, the adjusting means for each manifold plate 55 includes a pair of dam members 60, 61 that slide along the inside on opposite sides in the longitudinal direction (note the motion arrows in FIG. 6). As is apparent, the opposed dam members 60, 61 limit or direct the suction/positive pressure to the central portion of each section of the housing 57 to control the films 14, 18, as described. Adjustment rod 62 for each pair of the dam members 60, 61 are oppositely threaded from central connecting sleeve 63, and thus upon rotation by suitable manual wheels 64, 65 geared to rotate together, the rod 62 is effective to cause opposite linear translation of the dam members 60, 61. In this manner, once the manifold plate 55 is properly adjusted to the width W of the films, there is no loss of vacuum or positive pressure.

In order to provide easy operator accessibility to the manifold plate 55 in order to load the head-end $E_2$ and the tape T as a standby roll 16 is being readied for feeding a pair of arms 70, 71 are provided for mounting at stationary pivot pins 72 from frame member F of the feeding assembly 10 (see FIG. 5). The arms 70, 71 support the manifold plate 55, as well as the idler guide roller $R_2$. As illustrated, once the arms 70, 71 are released and pivoted to the open or loading position, the head-end $E_2$ and a tape T can be easily installed. An over center spring 75 can be provided for each arm 70, 71 in order to provide a convenient manner of positioning and securing the arms in either the operative or the loading positions (see the full line and the dotted line positions in FIG. 5).

As will be realized, the operator that loads the standby roll 16 is provided with a mechanism by which the task is easily performed as the manifold plate/housing 55, 57 forming either pneumatic means/manifold 32, 34 is easily switched between positions. To position the arms 70, 71 at the proper locations, spaced stops 77, 78 are provided. As illustrated, these stops are positioned relative to the pivot pin 72 so that the spring 75 goes over center, that is across the pivot pin 72 and thus locates and holds the manifold plate 55 in the proper relative position for loading, or for operation (compare the dotted line loading position at 70° from the horizontal, to the full line horizontal position for operation).

With reference back to FIG. 1, the additional functions of the programmable controller 48 within the control circuit C can be explained. The additional functions are generally dependent on the spaced eyemarks 42. First, a photoelectric cell 80 is connected by line 81 to the programmable controller 48. It is positioned just downstream from the splicing station 11 to read the spaced eyemarks 42 (see, for example, FIGS. *2a*, *2b*). In addition, an encoder 85 including a linear measuring wheel 86 is included in the circuit C and connected by the line 87 to the controller 48.

In operation, as soon as the tail-end $E_1$ triggers the end of film microswitch 45, the controller 48 is programmed to accept the linear measurement from the encoder 85. Previously, the predetermined distance from the splicing station 11 to the tail-end $E_1$ is programmed in the memory of the controller 48. This distance can be any distance that assures splicing before the tail-end passes the splicing station, but is preferably the distance between the eyemark 42 at the splicing station, and the next to last eyemark 42, as shown in FIG. *3a*.

The photocell 80 now senses the eyemark 42 and the measurement commences. Once the encoder wheel 86 senses this length of the film 14 passes (such as three bag lengths of film as shown in FIG. *3a*), the controller 48 initiates the splicing operation. In other words, once the first signal for the arrival of the eyemark 42 at the photocell 80 after the end-of-film signal is sent from the microswitch 45, the splicing location is determined by the encoder 85. In the example, it is set by the machine as three bag lengths. The splice is always adjacent the eyemark 42 and the center of the bag lengths of film 14, 18 so that the later cut-off in the packaging machine is clean.

At the appointed time, the valve 44 rapidly switches from the vacuum source 35 to the pressure source 38, thereby providing the blast of air to blow the head-end $E_2$ and the tape T and splice the films 14, 18 together. As illustrated, once the predetermined distance is determined, such as three bag lengths as illustrated, the splicing can occur in a timed and efficient fashion without intervention by the operator. Of course, in certain instances where the tail-end $E_1$ is cut-off at less than a full bag length, the final eyemark 42 is the one that is adjacent the splicing station 11 (approximately under the photocell 80) when the splicing operation occurs. In either case, a minimum length of the tail-end $E_1$ on the film 14 remains in order to minimize the waste.

With reference now back to FIG. 1, more detail of the packaging machine M can be given. Thus, a photocell 100 is positioned to read the same eyemark 42 in order to provide a signal to the controller 48 for operation of the components of the machine M. More particularly, a product filling means 101 is activated in timed relationship to dump a charge of product P, such as potato chips, through a filling tube 102. The web 14 is tensioned and pulled around the tube 102 and over a former by endless belts 103, which in turn are substantially continuously driven by a servo machine drive 104 that is timed in a conventional manner from the controller 48. In addition to the feed belts 103, the machine drive controls the operation of sealing jaw/cut-off knife 105 and the oscillation of the carriage 106 to form the series of packages or bags. Since the programmable controller 48 utilizes the same eyemarks 42 to control the machine M as it does to control the feeding assembly 10, the entire operation can be appropriately synchronized and coordinated, and the entire film feeding and packaging operation can be most efficiently carried out. However, in some instances such as for retrofit applications dual programmable controllers may be employed and they are networked together.

The photocell 100 provides input signals to the controller 48, which in turn counts the predetermined number of bag lengths between the splicing station 11 and package forming station 110 in the packaging machine M. At the point when the overlapping film tail-end $E_1$ and head-end $E_2$ sections, that form the spliced section of the films 14, 18 arrives at the packaging forming station 110, as indicated by the count, a dry cycle is initiated by inhibiting the product filling means 101. In this manner, only one overlapping bag section of the overlapping films 14, 18 is discarded, no product is involved and thus the waste is minimized.

In practicing the method of the present invention for substantially continuously feeding packaging film, the first requirement is to mount the two rolls 12, 16 in the feeding assembly 10 for sequentially unwinding in order to form a substantially continuous flow of packages or bags, each said roll having a head-end and a tail-end. The film 14 that is being actively unwound substantially continuously feeds along the feed paths into the packaging machine M. The next step is applying adhesive means, such as the tape T, to the head-end $E_2$ of the film 18 of the standby roll 16 as it is being held on the pneumatic means/manifold 34. Tensioning of the active film 14 along the feed path P is provided at least adjacent the tail-end $E_1$ by the pneumatic means/manifold 32.

Finally, positive pressure is provided at the splicing station 11 to generate an air blast with sufficient air flow to blow the tail-end/head-end of the films together and provide the splicing function by causing the tail-end to stick to the adhesive means. As a result, the film of the standby roll is securely spliced to the film of the active roll to provide film feeding substantially without interruption and without slow down.

In the method, it is also important to detect the tail-end $E_1$ of the film 42 of the active roll 12 at a detection point along the feed path P as it approaches the splicing station 11. Upon detection, the tensioning step is initiated, such as providing suction to the pneumatic means/manifold 32 (see FIG. 3*b*).

In order to ensure interference free loading of the film 18 of the standby roll 16, it is important to provide a loading station L spaced a substantial distance from the splicing station 11. Applying the head-end $E_2$ is performed at the loading station L (see FIG. 5).

In another important aspect of the method, eyemarks 42 are provided at spaced locations along the film 14, 18. These eyemarks are positioned at approximately a midpoint between the designated seal areas of the package/bag. As the tail-end $E_1$ is detected (see FIG. 3*d*), the eyemarks on the film 14 are sensed by the photocell 80 at a position just downstream of the splicing station 11. The length of film 14 remaining at that time (such as three-bag lengths) between the splicing station 11 and the tail-end $E_1$ is premeasured and stored in the memory of the programmable controller 48.

The encoder/wheel 85, 86 is instrumental in calculating the length of film and thus the number of eyemarks remaining in the film 14 until the tail-end $E_1$ reaches the splicing station 11. Rapidly switching the pneumatic means/manifold 32 from a suction mode to a positive pressure mode thus occurs to make certain that splicing operation takes place while at least some remaining film is on the tail-end $E_1$. However, since the splicing occurs adjacent the next to last/last eyemark 42, the packaging film 14 to be discarded is minimized.

Once the splice is made at splicing station 11, it is important that the section with the splice is tracked through the system to the packaging machine M. Since the splice is made at the midpoint of a bag section of the films 14, 18, it is known that this limited film is the only waste. More specifically, in the method, by preprogramming, the controller 48 is set so that there is a known number of bag sections or eyemarks 42 from the splicing station 11 through to the bag forming station 110. The photocell 100 keeps track of the number of eyemarks 42 (see FIG. 1) and at the point when the spliced bag section arrives at the bag forming station 110, the product filling means 101 is inhibited by the signal from the controller 48 so that the product P is not fed into the tube 102. The sealing jaws/knives 105 operate to cut out the splice bag section, and it is discarded from the stream of acceptable formed, filled and sealed packages. As a result, not only is the amount of film 14, 18 that is wasted minimized, but none of the product P is wasted in the operation accordingly to the present invention.

It will be realized at this point in the operation of the feeding assembly 10 and the packaging machine M that the roll 16 on the spindle 24 and the film 18 now becomes active, and the spindle 20 is now empty. An appropriate signal is provided to the operator and he promptly provides a new roll 12 of the film 14, which now becomes the standby roll. The operator simply pivots the arms 70, 71 supporting the pneumatic means/manifold 32 to the dotted line loading position, shown in FIG. 5, prepares the head-end of the film 14, and suction is provided to hold the new head-end and the adhesive tape in position. The arms 70, 71 are then pivoted about the pivot support 72 to the ready position at the splicing station 11, and the entire process of splicing the film 14 to the now active film 18 is ready to proceed, in accordance with the same procedure as described above.

In summary, the film feeding assembly 10 and the related method provides substantial results and advantages over the prior art approaches. The active/standby films 14, 18 are automatically spliced together in a substantially continuous manner. There is no need for an operator to standby and interrupt the packaging machine M in order to load a new roll of film. A substantial window for loading the new, standby roll is provided as the active roll is being fed and packages are being formed in a continuous manner. A single operator can now take care of many more machines without difficulty.

In a novel manner, the programmable controller 48 controls the feeding assembly 10, as well as the packaging machine M, and coordinates the operations to perfection. Advantageously, the splice section is efficiently formed at the splicing station 11 by a blast of air that causes the head-end $E_2$ of the standby roll 16 to be blown against the tail-end $E_1$ of the active roll 12. Thus, there are no mechanical parts that are forced together and cause a slapping of the webs. The maintenance problems of the past and potential rupture of the films 14, 18 are alleviated. When the film of the one of the rolls 12, 16 is depleted, the operator has easy access to the pneumatic means/manifold 32, 34 by simply swinging the appropriate one to a loading station L (see FIG. 5). Finally, the amount of discarded packaging film 14, 18 at the spliced section is minimized due to the ability to efficiently track it through the feeding assembly 10 and the packaging machine M. At the point when the splice section arrives at the packaging forming station 110, only this single section is removed, and no product P is included.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An assembly for substantially continuously feeding packaging film into a form, fill, and seal packaging machine comprising:

means for supporting and unwinding an active and a standby roll of film;

each roll having a tail-end and a head-end of its film;

each roll further having adhesive means on the head-end of the film of the standby roll;

means for continuously feeding the film of the active roll along a feed path into the machine;

first pneumatic means for tensioning the film of said active roll at least adjacent said tail-end;

second pneumatic means opposed to said first pneumatic means for holding said head-end and said adhesive means at a splicing station adjacent said feed path;

at least one of said first and second pneumatic means including a vacuum source to provide suction for the tensioning and holding functions and a pressure source to generate an air blast to blow at least one of the said tail-end and said head-end of the films toward each other;

control means for rapidly switching at least said first pneumatic means between said vacuum source and said pressure source;

said pressure source providing sufficient air flow to cause said tail-end to stick to said adhesive means;

whereby the film of said standby roll is securely spliced to the film of said active roll to provide film feeding to said machine substantially without interruption and without slow-down.

2. The continuous feeding assembly of claim 1 wherein said supporting and unwinding means includes:

an active spindle for said active roll;

a standby spindle for said standby roll; and means for controlling said active spindle to substantially match the tangential speed of said active roll to the speed of said film along said path.

3. The continuous feeding assembly of claim 2 wherein said control means further includes:

a programmable controller;

means for detecting the tail-end of the film of said active roll moving along said feed path between said active spindle and said first pneumatic means to provide a tail-end signal to said controller; and a valve operable in response to said controller for applying said vacuum source to said first pneumatic means in response to said tail-end signal to provide said film tensioning upon detection of the tail-end of the film of said active roll.

4. The continuous feeding assembly of claim 3 wherein said film includes registration eyemarks and said control means further includes:

a programmable controller;

means for detecting said eyemarks proximately mounted a predetermined distance from said splicing station to provide a signal to said controller;

means for measuring the length of film fed along said feed path to provide a signal to said controller; and means for calculating the number of eyemarks remaining on said film until said tail-end reaches said splicing station;

said switching means being operated upon detection of the next to last or last eyemark on the film by said detection means.

5. The continuous feeding assembly of claim 1 wherein at least said first pneumatic means comprises:

an elongated housing including an inlet port for receiving said vacuum source and said pressure source and a manifold with spaced openings through which said vacuum source and said pressure source are applied to said film.

6. The continuous feeding assembly of claim 5 wherein said elongated housing further includes:

means for adjusting the effective width of said manifold across which said vacuum source and said pressure source are applied.

7. The continuous feeding assembly of claim 6 wherein said width adjustment means includes:

dam members mounted on opposite sides of said housing and movable in the longitudinal direction; the said dam members directing the vacuum and pressure to a central portion of said housing;

an oppositely threaded rod engaging said dam members in said housing, the rotation of said threaded rod effecting opposite linear translation along said threaded rods; and means for rotating said threaded rod for adjustment of said dam members.

8. The continuous feeding assembly of claim 5 wherein said elongated housing further includes:

pivotal mounting means to allow movement substantially away from said splicing station and from said feed path and to a film loading station for easy operator accessibility to facilitate loading of the head-end of said film to be held at said splicing station.

9. The continuous feeding assembly of claim 8 wherein said pivotal mounting means includes:

a pair of arms supporting the ends of said housing, pivot means for supporting each of said arms; and an over-center spring with respect to said pivot means and spaced stops for selectively positioning said elongated housing at said splicing and loading stations, whereby operator switching of said housing between stations is facilitated.

10. A form, fill and seal packaging machine including a splicing assembly to allow substantially continuous feeding of packaging film with spaced registration eyemarks and from at least two rolls comprising:

means for supporting and unwinding an active and a standby roll of film to the machine;

each roll having a head-end and tail-end of its film;

means for substantially continuously feeding film along a feed path from said active roll into and through the machine;

means for splicing the tail-end of said active roll to the head-end of said standby roll;

said splicing means creating a recognizable splice section in said film;

means for forming said film into a package;

means for sealing the package;

machine drive means for synchronously actuating said forming means and said sealing means;

means for filling each formed package with product;

control means for coordinating said machine drive means and said product filling means to provide a series of sealed packages containing the product and a dry cycle at said splice section, whereby, all completed formed, filled and sealed packages are acceptable.

11. The packaging machine and splicing assembly of claim 10, wherein said control means comprises a programmable controller; and photocell means for sensing said spaced eyemarks on said film of said rolls of packaging film.

12. The method of substantially continuously feeding packaging film into a form, fill and seal packaging machine from an active roll and standby roll, comprising the steps of:

supporting and unwinding the packaging film from the active roll of film, each said roll having a head-end and a tail-end;

substantially continuously feeding the film of the active roll along a feed path into the machine;

applying adhesive means to the head-end of the film of said standby roll;

holding said head-end and said adhesive means at a splicing station adjacent said feed path;

tensioning the film of said active roll along said feed path at least adjacent said tail-end of the film of said active roll; and rapidly applying positive pressure at said splicing station to generate sufficient air flow to blow at least one of the said tail-end and said head-end of the films toward each other to cause said tail-end to stick to said adhesive means, whereby the film of said standby roll is securely spliced to the film of said active roll to provide film feeding to said machine substantially without interruption and without slow-down.

13. The method of claim 12, wherein is provided the additional steps of:

detecting the tail-end of the active roll at a detection point along said feed path approaching said splicing station; and initiating said tensioning step upon detection of said tail-end at said detection point.

14. The method of claim 12 wherein is provided the additional step of:

providing a loading station spaced from said splicing station; and performing the applying step at said loading station.

15. The method of claim 12 wherein the step of holding said head-end and said adhesive means is performed by:

providing a manifold at the splicing station for receiving said head-end and said adhesive means in overlapping relationship; and applying a vacuum through said manifold to at least said head-end.

16. The method of claim 15 wherein the film includes registration eyemarks and wherein is provided the additional steps of:

detecting eyemarks on said film at a position proximate to said splicing station;

detecting said tail-end of the film of the active roll at a detection point along said feed path approaching said splicing station;

measuring the length of film fed along said feed path;

calculating the number of eyemarks remaining in the film until the tail-end of the active roll reaches the splicing station;

rapidly switching from the application of said vacuum to the step of applying said pressure upon detection of the next to last or last eyemark.

17. The method of continuously feeding, splicing and tracking packaging film into and through a form, fill and seal packaging machine forming a series of filled packages comprising the steps of:

supporting and unwinding an active and a standby roll of film, each said roll having a head-end and a tail-end of its film;

continuously feeding the film of the active roll along a feed path into the machine;

splicing the tail-end of the film of said active roll to the head-end of the film of said standby roll substantially without stopping movement of the film along the feed path;

creating a recognizable splice section where said tail-end and said head-end are spliced;

tracking the splice section through the machine;

forming, filling and sealing each completed package;

generating a dry cycle mode of the machine when said splice section is positioned at least the package forming or filling station of the machine; and removing the splice section from the series of completed packages, whereby all completed formed, filled and sealed packages are acceptable.

18. An assembly for substantially continuously feeding an indeterminate length web into a machine for processing means for supporting and unwinding an active and a standby roll of webs;

each roll having a tail-end and a head-end of its web;

means for continuously feeding the web of the active roll along a feed path into the machine;

adhesive means on the head-end of the web of the standby roll;

first pneumatic means for tensioning the web of said active roll at least adjacent said tail-end;

second pneumatic means opposed to said first pneumatic means for holding said head-end and said adhesive means at a splicing station adjacent said feed path;

at least one of said first and second pneumatic means including a vacuum source to provide suction for the tensioning and holding functions and a pressure source to generate an air blast to blow at least on of the tail-end and head-end of the webs toward each other;

control means for rapidly switching at least said first pneumatic means between said vacuum source and said pressure source;

said pressure source providing sufficient air flow to cause said tail-end to stick to said adhesive means;

whereby the web of said standby roll is securely spliced to the web of said active roll to provide web feeding to said machine substantially without interruption and without slow-down.

* * * * *

UNITED STATES PATENT AND TRADEMARK OFFICE

CERTIFICATE OF CORRECTION

PATENT NO. : 5,388,387

DATED : February 14, 1995

INVENTOR(S) : Howell T. McElvy

It is certified that error appears in the above-indentified patent and that said Letters Patent is hereby corrected as shown below:

In Claim 18, column 17, line 8, change "on" to --one--.

Signed and Sealed this

Twenty-fifth Day of April, 1995

Bruce Lehman

*Attest:*

BRUCE LEHMAN

*Attesting Officer*

*Commissioner of Patents and Trademarks*